US010236569B2

(12) United States Patent
Mukai et al.

(10) Patent No.: US 10,236,569 B2
(45) Date of Patent: Mar. 19, 2019

(54) ANTENNA DEVICE

(71) Applicant: Kabushiki Kaisha Toshiba, Tokyo (JP)

(72) Inventors: Manabu Mukai, Kanagawa (JP); Koh Hashimoto, Kanagawa (JP); Makoto Sano, Kanagawa (JP); Makoto Higaki, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 15/477,916

(22) Filed: Apr. 3, 2017

(65) Prior Publication Data

US 2017/0365920 A1 Dec. 21, 2017

(30) Foreign Application Priority Data

Jun. 16, 2016 (JP) ..... 2016-120130

(51) Int. Cl.

| | |
|---|---|
| ***H01Q 1/42*** | (2006.01) |
| ***H01Q 9/04*** | (2006.01) |
| ***H01Q 1/40*** | (2006.01) |
| ***H01Q 1/52*** | (2006.01) |
| ***H01Q 21/06*** | (2006.01) |

(52) U.S. Cl.

CPC ..... *H01Q 1/42* (2013.01); *H01Q 1/405* (2013.01); *H01Q 1/526* (2013.01); *H01Q 9/0407* (2013.01); *H01Q 9/0485* (2013.01); *H01Q 21/064* (2013.01); *H01Q 21/065* (2013.01)

(58) Field of Classification Search

CPC ..... H01Q 1/42; H01Q 1/1271; H01Q 1/38; H01Q 9/0407

USPC ..... 343/872, 713, 873, 700 MS

See application file for complete search history.

(56) References Cited

U.S. PATENT DOCUMENTS

| | | | | |
|---|---|---|---|---|
| 6,215,454 | B1 | 4/2001 | Tran | |
| 2002/0036589 | A1 | 3/2002 | Taira et al. | |
| 2004/0135731 | A1* | 7/2004 | Komatsu | H01Q 1/1271 343/713 |
| 2004/0189532 | A1 | 9/2004 | Nakano et al. | |
| 2007/0046544 | A1* | 3/2007 | Murofushi | H01Q 1/22 343/700 MS |
| 2010/0127939 | A1 | 5/2010 | Yusa | |
| 2012/0044113 | A1* | 2/2012 | Satoh | H01Q 1/06 343/702 |
| 2014/0247195 | A1* | 9/2014 | Yen | H01L 23/66 343/873 |
| 2016/0036111 | A1 | 2/2016 | Gregoire et al. | |

FOREIGN PATENT DOCUMENTS

| | | | |
|---|---|---|---|
| JP | H06-196911 | A | 7/1994 |
| JP | 2001-520856 | A | 10/2001 |
| JP | 2002100926 | A | 4/2002 |
| JP | 2004-214819 | | 7/2004 |

(Continued)

*Primary Examiner* — Dameon E Levi
*Assistant Examiner* — Collin Dawkins
(74) *Attorney, Agent, or Firm* — Baker Botts L.L.P.

(57) ABSTRACT

According to one embodiment, an antenna device includes: an antenna substrate which comprises on a front surface thereof a radiation element for transmitting/receiving radio waves; a dielectric layer which covers the front surface and a back surface of the antenna substrate; and a first conductive layer which covers a side surface of the antenna substrate.

9 Claims, 8 Drawing Sheets

(56) References Cited

FOREIGN PATENT DOCUMENTS

| | | | |
|---|---|---|---|
| JP | 2004304621 | A | 10/2004 |
| JP | 2005294892 | A | 10/2005 |
| JP | 2016-036129 | A | 3/2016 |
| WO | 2008136408 | A1 | 11/2008 |

* cited by examiner

ANTENNA DEVICE

CROSS-REFERENCE TO RELATED APPLICATIONS

This application is based upon and claims the benefit of priority from the prior Japanese Patent Application No. 2016-120130, filed Jun. 16, 2016, the entire contents of which are incorporated herein by reference.

FIELD

The embodiments relate to an antenna device comprising a planar antenna covered by a radome.

BACKGROUND

A planar antenna (antenna substrate) which transmits/receives radio waves in satellite communications, etc. has been proposed. A planar antenna has high directivity and transmits/receives radio waves on its front surface. In order to improve waterproof properties, impact strength, and rigidity, the planar antenna is covered by a radome comprised of thermoplastic resin (dielectric).

However, a part of the radio waves transmitted (radiated) from the front surface of the planar antenna propagate as surface waves along the surrounding radome. Therefore, the part of the radio waves propagate from the front surface of the planar antenna to the side surface or the back surface thereof. As a result, undesired radio wave radiation from directions (side surface side or back surface side) other than a main radiation direction (front surface side) of the planar antenna will increase, thereby deteriorating the directivity of the antenna. Especially in the case of satellite communications where directivity characteristics of the back surface side are regulated, it is possible that the directivity characteristics may exceed regulation values.

DETAILED DESCRIPTION

Figure 1:
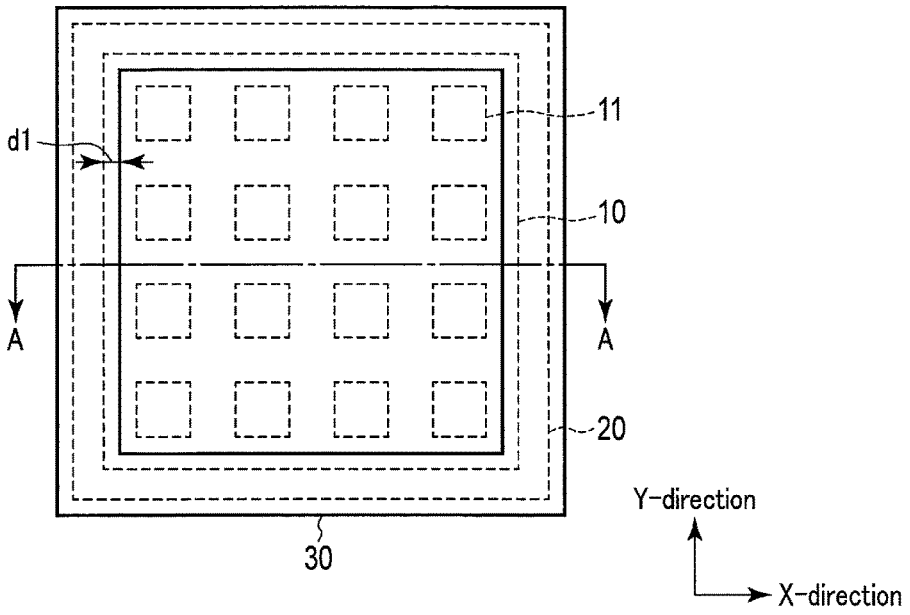
FIG. 1 is a plan view of an antenna device according to a first embodiment.

In general, according to one embodiment, an antenna device includes: an antenna substrate which comprises on a front surface thereof a radiation element for transmitting/receiving radio waves; a dielectric layer which covers the front surface and a back surface of the antenna substrate; and a first conductive layer which covers a side surface of the antenna substrate.

Hereinafter, the present embodiments will be described with reference to the drawings. In the drawings, identical portions will be given identical reference symbols.

First Embodiment

In the following, FIGS. 1, 2, 3, 4, 5, 6, and 7 will be used to explain an antenna device according to a first embodiment.

Configuration in First Embodiment

Figure 2:
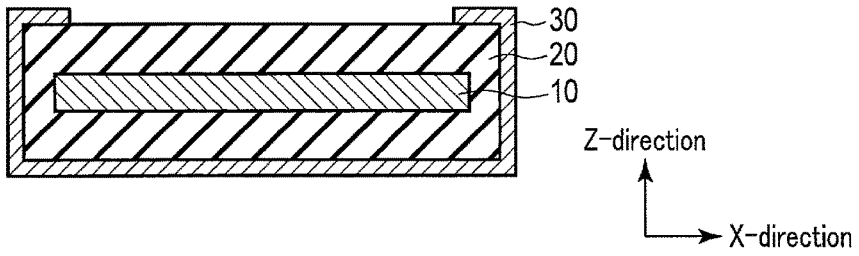
FIG. 2 is a cross-sectional view of the antenna device according to the first embodiment.

FIG. 1 is a plan view of the antenna device according to the first embodiment. FIG. 2 is a cross-sectional view of an antenna device according to the first embodiment taken along line A-A of FIG. 1.

In the following explanation, a front surface refers to an upper surface in a Z-direction, and a back surface refers to a lower surface in the Z-direction. A side surface refers to a surface intersecting the front surface and the back surface.

As shown in FIG. 1 and FIG. 2, the antenna device includes an antenna substrate 10, a dielectric layer 20, and a conductive layer 30.

The antenna substrate 10 is a planar antenna, which is plate-like and spreads in an X-direction and a Y-direction (surface directions). The antenna substrate 10 includes a plurality of conductive layers and dielectric layers which are unillustrated, that are laminated in the Z-direction. The plurality of conductive layers include a signal line and a grounding line which corresponds to the signal line. The antenna substrate 10 also includes a plurality of radiation elements 11. The plurality of radiation elements 11 are arranged side by side in the X-direction and the Y-direction in a matrix. The plurality of radiation elements 11 are patch antennas or slot antennas, however, are not limited thereto. The plurality of radiation elements 11 transmit/receive radio waves from the front surface of the antenna substrate 10. In other words, the front surface of the antenna substrate 10 becomes the main radiation direction of the radio waves.

The dielectric layer 20 is provided around the antenna substrate 10. In other words, the dielectric layer 20 covers the front surface, the back surface, and the side surface of the antenna substrate 10. The dielectric layer 20 is a radome and includes, for example, a thermoplastic resin. This dielectric layer 20 improves waterproof properties, impact strength, and rigidity of the antenna substrate 10. The dielectric layer 20 may be comprised of a single layer (continuous layer) around the antenna substrate 10, or may be comprised of different layers (discontinuous layers). In the case where the dielectric layer 20 is comprised of different layers, the layers of the dielectric layer 20 will each be different for, for example, the front surface, the back surface, and the side surface of the antenna substrate 10.

The conductive layer 30 covers a part of the front surface from the edge (a part of the front surface continuing from the side surface), the back surface, and the side surface of the dielectric layer 20. Therefore, the conductive layer 30 covers a part of the front surface from the edge, the back surface, and the side surface of the antenna substrate 10 through the dielectric layer 20. The conductive layer 30 is a single layer which is continuously provided on a part of the front surface from the edge, the back surface, and the side surface of the dielectric layer 20. The conductive layer 30 includes, for example, a metal layer (for example, an aluminum layer) formed by vapor deposition or a conductive coating material. When observed from the front surface side, the conductive layer 30 does not cover the radiation elements 11 of the antenna substrate 10. In other words, the conductive layer 30 does not exist above the radiation elements 11 (on the front surface side), therefore, the radiation elements 11 are exposed on the front surface side from the conductive layer 30.

Effect in First Embodiment

Figure 3:
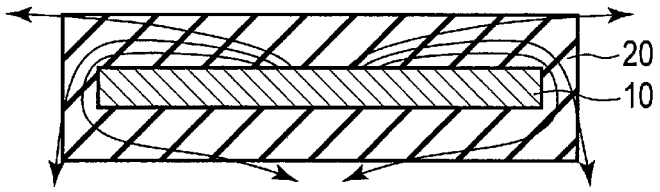
FIG. 3 shows radio wave radiation in an antenna device according to a comparative example.
Figure 4:
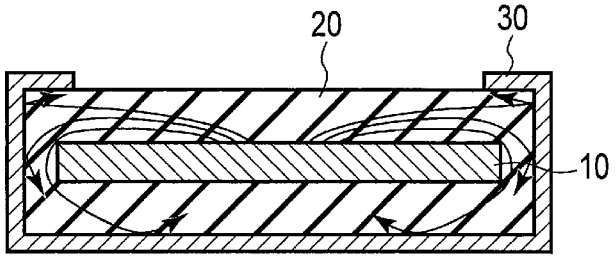
FIG. 4 shows radio wave radiation in the antenna device according to the first embodiment.
Figure 5:
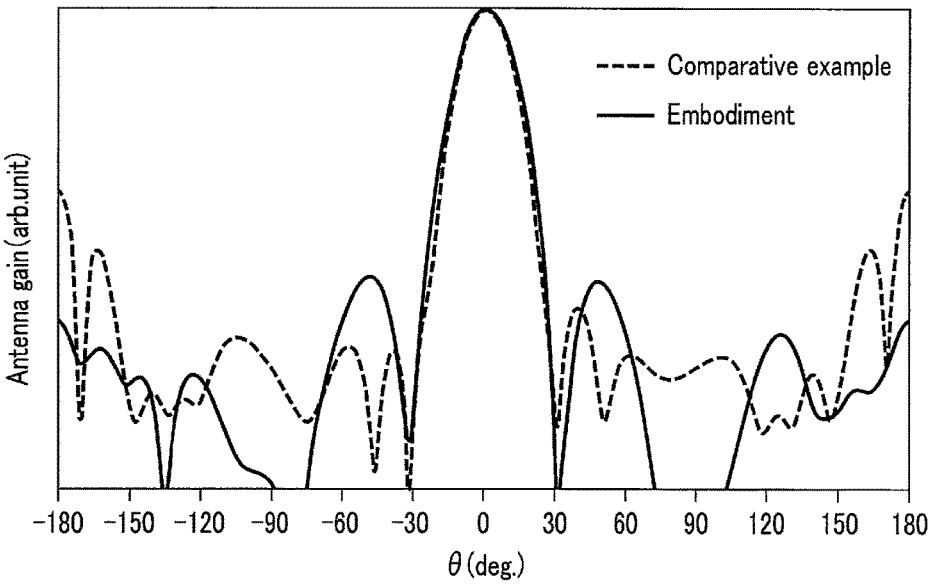
FIG. 5 shows antenna gains in the antenna devices according to the first embodiment and the comparative example.

FIG. 3 shows radio wave radiation in an antenna device according to a comparative example, and FIG. 4 shows radio wave radiation in the antenna device according to the first embodiment. FIG. 5 shows antenna gains (signal intensities) in the antenna devices according to the first embodiment and the comparative example.

As shown in FIG. 3, in the antenna device of the comparative example, the conductive layer 30 of the first embodiment is not provided. In the comparative example, a part of the radio waves radiated from the front surface of the antenna substrate 10 propagate as a surface wave along the surrounding dielectric layer 20. Therefore, a part of the radio waves propagate from the front surface to the side surface or the back surface of the antenna substrate 10. Since the radio waves are radiated (reradiated) from directions (side surface side or back surface side) other than the main radiation direction (front surface side) of the antenna substrate 10, directivity is deteriorated.

In contrast, as shown in FIG. 4, in the antenna device of the first embodiment, the conductive layer 30 is provided around the dielectric layer 20 (a part of the front surface from the edge, the back surface, and the side surface). In the first embodiment, in the same manner as the comparative example, the radio waves propagate from the front surface to the side surface or the back surface of the antenna substrate 10 along the dielectric layer 20. However, the radio waves are reflected at the interface of the dielectric layer 20 and the conductive layer 30. Due to this, the radio waves can be suppressed from being reradiated from the side surface and the back surface of the dielectric layer 20 (undesired radiation), thereby suppressing a deterioration in the directivity of radio wave transmission.

More specifically, as shown in FIG. 5, the antenna gain of the first embodiment is smaller than the antenna gain of the comparative example at both the side surface ($\theta$=90, −90) and the back surface ($\theta$=180, −180) of the antenna substrate 10.

Furthermore, in the first embodiment, when the antenna substrate 10 receives radio waves, radio wave noise from the side surface side and the back surface side can be shielded by the conductive layer 30. Due to this, the antenna substrate 10 is capable of receiving only the radio waves from the front surface side, without receiving the radio wave noise from the side surface side and the back surface side. Therefore, the deterioration in directivity upon receiving radio waves may be suppressed.

Furthermore, in the first embodiment, the conductive layer 30 does not exist above (on the front surface side of) the radiation elements 11, thereby exposing the radiation elements 11 from the conductive layer 30. Due to this, the deterioration of the antenna characteristics may be suppressed without the transmission/reception of the radio waves from the radiation elements 11 on the front surface side being disturbed by the conductive layer 30.

Modified Example in First Embodiment

Figure 6:
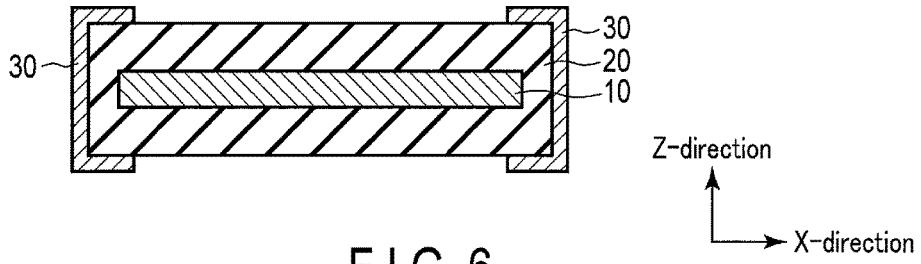
FIG. 6 shows a first modification of the antenna device according to the first embodiment.

FIG. 6 shows a first modification of the antenna device according to the first embodiment.

As shown in FIG. 6, in the first modification, the conductive layer 30 covers a part of the front surface from the edge and a part of the back surface from the edge, and the side surface of the dielectric layer 20. In other words, the conductive layer 30 is not provided on the entire surface of the back surface of the dielectric layer 20, which is different from the first embodiment. The conductive layer 30 is a single layer which is provided continuously on a part of the front surface from the edge, a part of the back surface from the edge, and the side surface of the dielectric layer 20.

Figure 7:
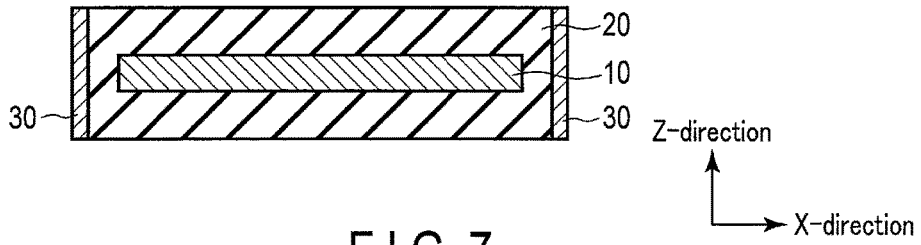
FIG. 7 shows a second modified example of the antenna device according to the first embodiment.

FIG. 7 shows a second modification of the antenna device according to the first embodiment.

As shown in FIG. 7, in the second modification, the conductive layer 30 covers only the side surface of the dielectric layer 20. In other words, the conductive layer 30 is not provided on the front surface and the back surface of the dielectric layer 20, which is different from the first embodiment.

Undesired radiation of radio waves from the antenna substrate 10 occurs, especially from the side surface. Therefore, as in the first modification and the second modification, by the conductive layer 30 covering the side surface of the dielectric layer 20 (antenna substrate 10), undesired radiation of radio waves may be suppressed in substantially the same manner as the first embodiment.

Although unillustrated, the conductive layer 30 may also be provided only on the side surface and a part from the edge of the front surface of the dielectric layer 20, or only on the side surface and the back surface (a part from the edge of the back surface) of the dielectric layer 20. In other words, the conductive layer 30 does not have to be provided on one of the front surface and the back surface of the dielectric layer 20.

Second Embodiment

In the following, an antenna device according to a second embodiment will be explained using FIG. 8 and FIG. 9. In the second embodiment, explanations on the matters which are the same as in the first embodiment are omitted, and mainly those matters which are different are explained.

Configuration in Second Embodiment

Figure 8:
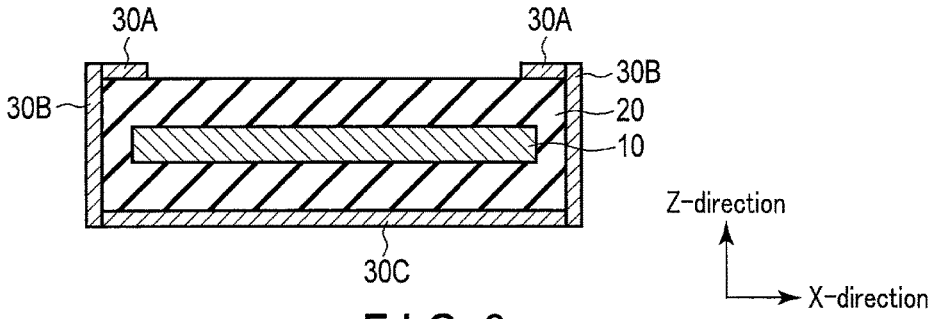
FIG. 8 is a cross-sectional view of an antenna device according to a second embodiment.

FIG. 8 is a cross-sectional view of the antenna device according to the second embodiment.

As shown in FIG. 8, in the second embodiment, the conductive layer 30 is not a single layer, which is a matter different from the first embodiment.

A dielectric layer 20 is covered by conductive layers 30A, 30B, and 30C. The conductive layer 30A covers a part from the edge of a front surface of the dielectric layer 20, the conductive layer 30B covers the side surface of the dielectric layer 20, and the conductive layer 30C covers the back surface of the dielectric layer 20. In other words, the conductive layers 30A, 30B, and 30C are different layers that are provided discontinuously. The conductive layers 30A, 30B, and 30C are provided as a flat plate. As this kind of flat plate, a metal flat plate or a carbon fiber reinforced plastic (CFRP) flat plate is used. The conductive layer 30A and the conductive layer 30B may be adjoined or may be separated. In the same manner, the conductive layer 30B and the conductive layer 30C may be contact, or may be separated. In other words, the conductive layers may be electrically connected or may be insulated.

Effect in Second Embodiment

The second embodiment can produce the same effect as the first embodiment.

Furthermore, in the second embodiment, the dielectric layer 20 is covered by flat plate conductive layers 30A, 30B, and 30C. In other words, the conductive layer 30 is formed by combining the flat plate conductive layers 30A, 30B, and 30C. Therefore, in the second embodiment, the device can be manufactured easier and less expensively than the conductive layer 30 in the first embodiment. Also, by using the CFRP flat plate as the conductive layer 30, the device may be made to be lightweight.

Modified Example in Second Embodiment

Figure 9:
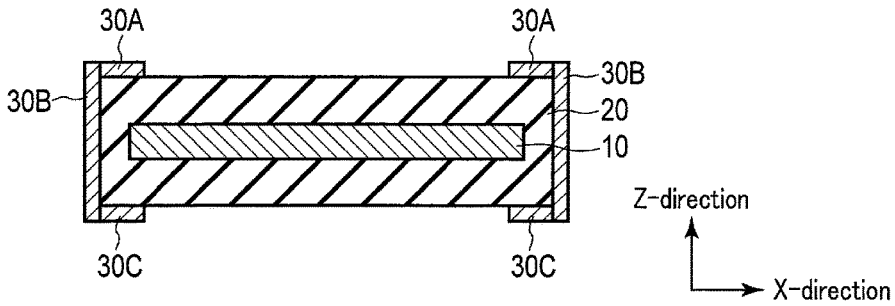
FIG. 9 shows a first modification of the antenna device according to the second embodiment.

FIG. 9 shows a first modification of the antenna device according to the second embodiment.

As shown in FIG. 9, in the first modification, the conductive layer 30A covers a part from the edge of the front surface of the dielectric layer 20, the conductive layer 30B covers the side surface of the dielectric layer 20, and the conductive layer 30C covers a part from the edge of the back surface of the dielectric layer 20. In other words, the conductive layer 30C is not provided on the entire surface of the back surface of the dielectric layer 20, which is different from the second embodiment. The conductive layer 30A and the conductive layer 30B may be adjoined or may be separated. In the same manner, the conductive layer 30B and the conductive layer 30C may be adjoined or may be separated.

Third Embodiment

In the following, an antenna device according to a third embodiment will be explained using FIG. 10. In the third embodiment, explanations on the matters which are the same as in the first embodiment are omitted, and mainly those matters which are different are explained.

Configuration in Third Embodiment

Figure 10:
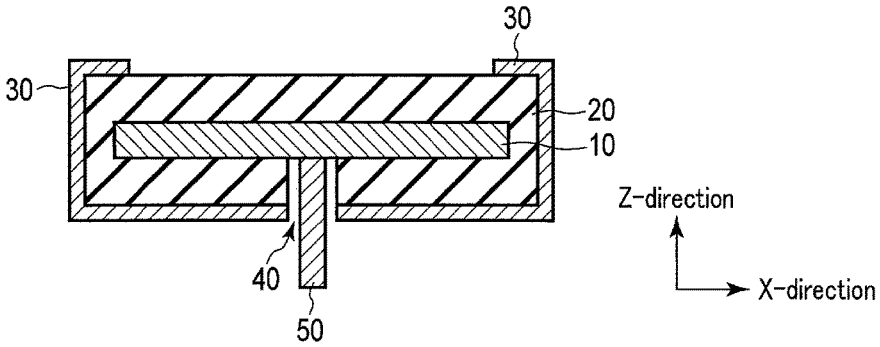
FIG. 10 is a cross-sectional view of an antenna device according to a third embodiment.

FIG. 10 is a cross-sectional view of the antenna device according to the third embodiment.

As shown in FIG. 10, in the third embodiment, a feeding unit 50 is provided, which is a matter different from the first embodiment.

On the back surface side of the antenna substrate 10, the dielectric layer 20 and the conductive layer 30 have an opening part 40. The opening part 40 in the dielectric layer 20 and the opening part 40 in the conductive layer 30 are provided at a position which corresponds in the X-direction and Y-direction. The opening part 40 is provided so as to reach the back surface of the antenna substrate 10 from the back surface of the conductive layer 30. In other words, the opening part 40 exposes the back surface of the antenna substrate 10. The opening part 40 in the dielectric layer 20 and the opening part 40 in the conductive layer 30 may have the same dimensions in the x-direction and the y-direction, or may have different dimensions.

The feeding unit 50 is provided inside the opening part 40 and is electrically connected to the exposed antenna substrate 10. The feeding unit 50 is, for example, a coaxial cable. The feeding unit 50 transmits radio waves to the antenna substrate 10, or receives radio waves from the antenna substrate 10.

Effect in Third Embodiment

According to the third embodiment, the dielectric layer 20 and the conductive layer 30 have opening parts 40 on the back surface side of the antenna substrate 10, and the feeding unit 50 is provided inside the opening parts 40. Due to this, the radio waves can be transmitted to the antenna substrate 10, or received from the antenna substrate 10. Here, the area of the opening part 40 provided on the conductive layer 30 is significantly smaller than the area of the antenna substrate 10. Therefore, leaked radio waves (undesired radiation of radio waves) from the opening part 40 of the conductive layer 30 is small. Accordingly, in the third embodiment, in substantially the same manner as in the first embodiment, undesired radiation of the radio wave can be suppressed.

Fourth Embodiment

In the following, an antenna device according to a fourth embodiment will be explained using FIG. 11 and FIG. 12. In the fourth embodiment, explanations on the matters which are the same as in the first embodiment are omitted, and mainly those matters which are different are explained.

Configuration in Fourth Embodiment

Figure 11:
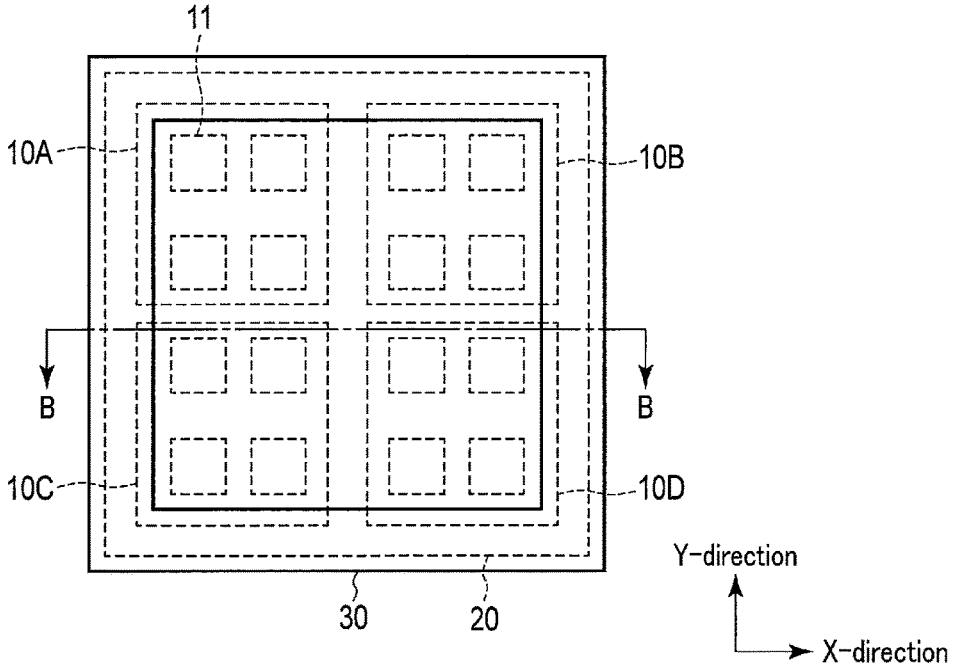
FIG. 11 is a plan view of an antenna device according to a fourth embodiment.

FIG. 11 is a plan view of the antenna device of the fourth embodiment. FIG. 12 is a cross-sectional view of the antenna device according to the fourth embodiment taken along line B-B of FIG. 11.

Figure 12:
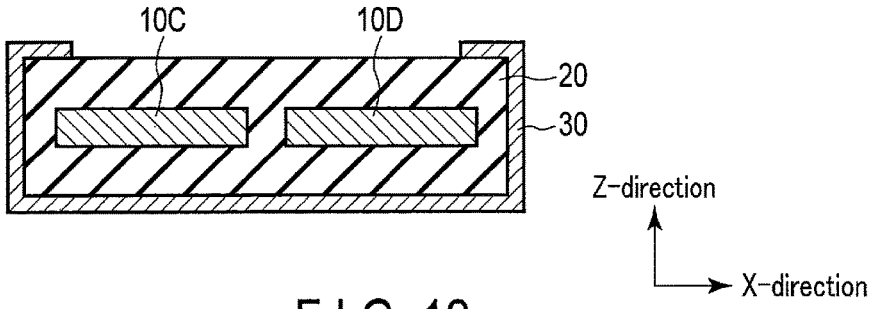
FIG. 12 is a cross-sectional view of the antenna device according to the fourth embodiment.

As shown in FIG. 11 and FIG. 12, in the fourth embodiment, an antenna substrate 10 includes a plurality of substrates 10A to 10D, which is a matter different from the first embodiment. In other words, the antenna substrate 10 is sub-arrayed.

The plurality of substrates 10A to 10D are arranged side by side in an X-direction and a Y-direction in a matrix. Each of the plurality of substrates 10A to 10D is a planar antenna, which is plate-like and spreads in the X-direction and the Y-direction. Each of the plurality of substrates 10A to 10D includes conductive layers and dielectric layers which are unillustrated, that are laminated in a Z-direction. The plurality of conductive layers include a signal line and a grounding line which corresponds to the signal line. Each of the plurality of substrates 10A to 10D includes a plurality of radiation elements 11.

Here, four substrates 10A to 10D have been explained; however, the number of sub-arrayed substrates is not limited to this, and can be changed as appropriate.

A dielectric layer 20 is provided around each of the plurality of substrates 10A to 10D. In other words, the dielectric layer 20 covers a front surface, a back surface, and a side surface of each of the plurality of substrates 10A to 10D. Therefore, the dielectric layer 20 covers an outer circumference side surface and an inner circumference side surface of the plurality of substrates 10A to 10D. Here, the inner circumference side surface of the substrate means the side surface facing a neighboring substrate. The outer circumference side surface of the substrate means the side surface other than that facing the neighboring substrate. In the case where the plurality of substrates 10A to 10D are provided in a manner contact with each other, the dielectric layer 20 is not provided on the inner circumference side surfaces thereof.

The conductive layer 30 covers a part from an edge of a front surface, a back surface, and a side surface of the dielectric layer 20. Therefore, the conductive layer 30 covers a part of the front surface continuous from the outer circumference side surface, the back surface, and the outer circumference side surface of the plurality of substrates 10A to 10D through the dielectric layer 20. However, the conductive layer 30 is not limited to this, and a part from the edge of the front surface and the back surface of the dielectric layer 20 (a part continuous from the outer circumference side surface of the front surface and the back surface of substrates 10A to 10D) may be uncovered. The conductive layer 30 also does not cover the inner circumference side surface of the plurality of substrates 10A to 10D. In other words, the conductive layer 30 is not provided between each of the plurality of substrates 10A to 10D. However, the conductive layer 30 is not limited to this, and may also cover the inner circumference side surface of the plurality of substrates 10A to 10D.

Effect in Fourth Embodiment

According to the fourth embodiment, the plurality of substrates 10A to 10D are provided as an antenna substrate 10. The conductive layer 30 covers a part of the front surface continuous from the outer circumference side surface, the back surface, and the outer circumference side surface of the plurality of substrates 10A to 10D. Here, the leaked radio waves from the inner circumference side surface of the plurality of substrates 10A to 10D are significantly smaller than the leaked radio waves from the outer circumference side surface of the plurality of substrates 10A to 10D. Accordingly, in the fourth embodiment, in substantially the same manner as in the first embodiment, undesired radiation of radio waves can be suppressed.

Fifth Embodiment

In the following, FIGS. 13, 14, 15, 16, and 17 will be used to explain an antenna device according to a fifth embodiment. In the fifth embodiment, explanations on the matters which are the same as in the first embodiment are omitted, and mainly matters which are different are explained.

Configuration in Fifth Embodiment

Figure 13:
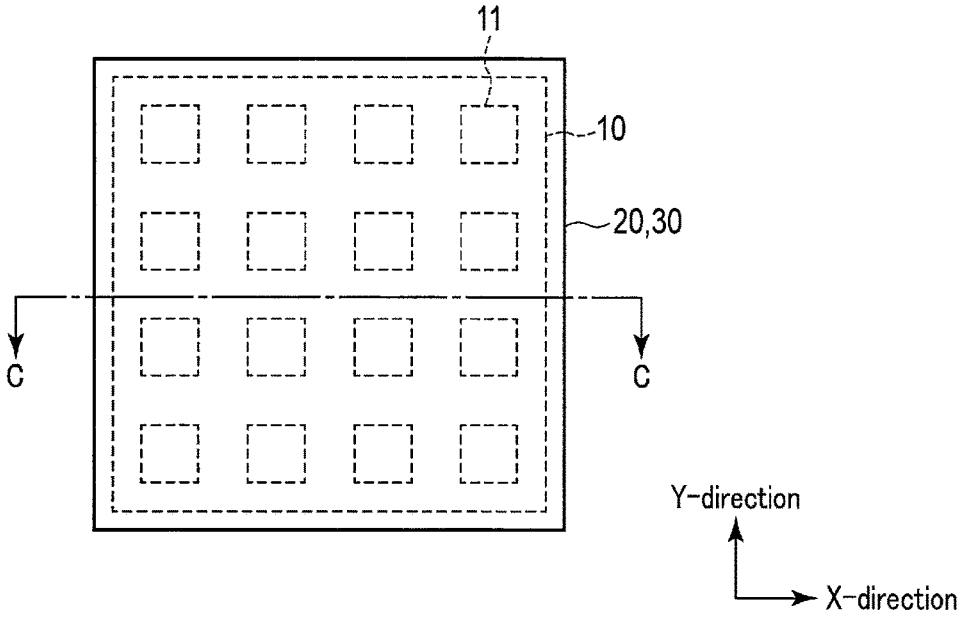
FIG. 13 is a plan view of an antenna device according to a fifth embodiment.
Figure 14:
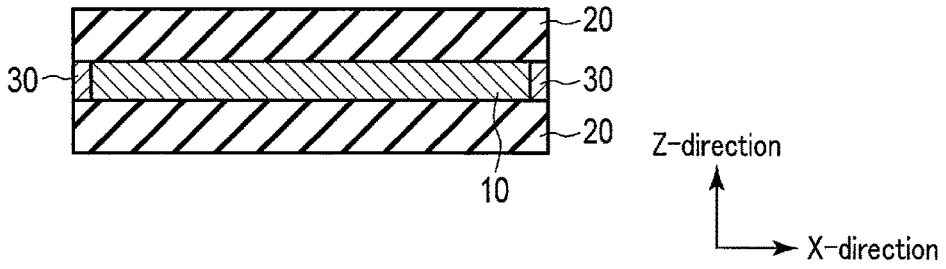
FIG. 14 is a cross-sectional view of the antenna device according to the fifth embodiment.

FIG. 13 is a plan view of the antenna device according to the fifth embodiment. FIG. 14 is a cross-sectional view of the antenna device according to the fifth embodiment taken along line C-C of FIG. 13.

As shown in FIG. 13 and FIG. 14, in the fifth embodiment, a conductive layer 30 is provided in a manner adjoined to a side surface of an antenna substrate 10, which is a matter different from the first embodiment.

A dielectric layer 20 covers a front surface and a back surface of the antenna substrate 10. The dielectric layer 20 is not provided on the side surface of the antenna substrate 10. Accordingly, the dielectric layer 20 is divided between the front surface and the back surface of the antenna substrate 10, and is each configured by different layers (discontinuous layers).

The conductive layer 30 is provided in a manner contact with the side surface of the antenna substrate 10, and covers the side surface of the antenna substrate 10. The dimension of the conductive layer 30 in a Z-direction and the dimension of the antenna substrate 10 in the Z-direction are the same. A front surface and a back surface of the conductive layer 30 are covered by the dielectric layer 20. The conductive layer 30 is provided as a flat plate. As this kind of flat plate, a metal flat plate or a CFRP flat plate is used. The conductive layer 30 is electrically insulated with a signal line included in the antenna substrate 10. On the other hand, the conductive layer 30 may be electrically connected or insulated with a grounding line included in the antenna substrate 10.

Effect in Fifth Embodiment

According to the fifth embodiment, the conductive layer 30 is provided in a manner contact with the side surface of the antenna substrate 10, and the dielectric layer 20 is not provided on the side surface of the antenna substrate 10. In other words, the dielectric layer 20 is divided at the side surface of the antenna substrate 10. Due to this, the radio wave radiated from the front surface of the antenna substrate 10 would not propagate to the side surface and the back surface of the antenna substrate 10 along the dielectric layer 20. Due to this, the fifth embodiment is capable of producing the same effect as the first embodiment above.

Furthermore, according to the fifth embodiment, a flat-plate conductive layer 30 is provided on the side surface of the antenna substrate 10. Due to this, the fifth embodiment is capable of producing the same effect as the second embodiment above.

Modified Example in Fifth Embodiment

Figure 15:
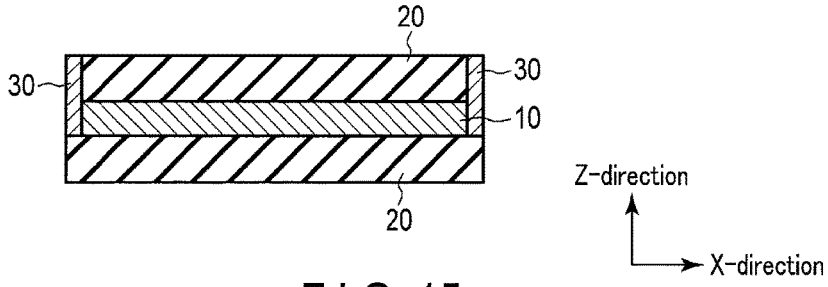
FIG. 15 shows a first modification of the antenna device according to the fifth embodiment.

FIG. 15 shows a first modification of the antenna device according to the fifth embodiment.

As shown in FIG. 15, in the first modification, the dimension of the conductive layer 30 in a Z-direction is larger than the dimension of the antenna substrate 10 in the Z-direction. The conductive layer 30 protrudes further towards the front surface side in the Z-direction than the antenna substrate 10. Therefore, the conductive layer 30 covers the side surface of the dielectric layer 20 on the front surface side of the antenna substrate 10.

Figure 16:
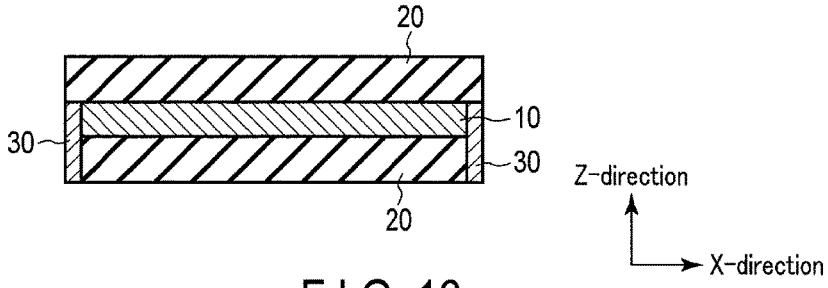
FIG. 16 shows a second modification of the antenna device according to the fifth embodiment.

FIG. 16 shows a second modification of the antenna device according to the fifth embodiment.

As shown in FIG. 16, in the second modification, the dimension of the conductive layer 30 in the Z-direction is larger than the dimension of the antenna substrate 10 in the Z-direction. The conductive layer 30 protrudes further towards the back surface side in the Z-direction than the antenna substrate 10. Therefore, the conductive layer 30 covers the side surface of the dielectric layer 20 on the back surface side of the antenna substrate 10.

Figure 17:
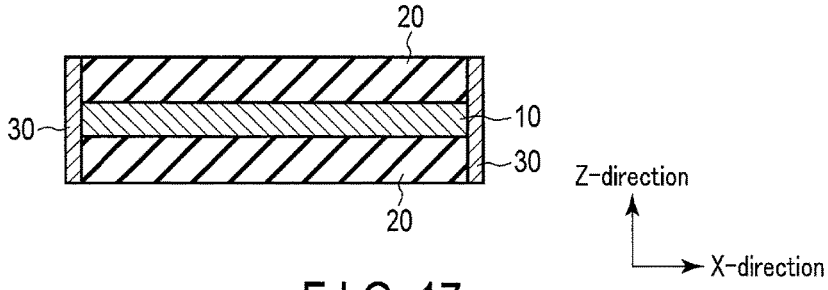
FIG. 17 shows a third modification of the antenna device according to the fifth embodiment.

FIG. 17 shows a third modification of the antenna device according to the fifth embodiment.

As shown in FIG. 17, in the third modification, the dimension of the conductive layer 30 in the Z-direction is larger than the dimension of the antenna substrate 10 in the Z-direction. The conductive layer 30 protrudes further towards the front surface side and the back surface side in the Z-direction than the antenna substrate 10. Therefore, the conductive layer 30 covers the side surface of the dielectric layer 20 on the front surface side of the antenna substrate 10, and the side surface of the dielectric layer 20 on the back surface side of the antenna substrate 10.

Each of the embodiments and each of the modifications mentioned above may be combined as appropriate.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna device comprising:

an antenna substrate which comprises on a front surface thereof a radiation element for transmitting/receiving radio waves;

a dielectric layer which covers the front surface and a back surface of the antenna substrate; and a first conductive layer which covers a side surface of the antenna substrate, wherein the dielectric layer is provided between the side surface of the antenna substrate and the first conductive layer, and further covers the side surface of the antenna substrate, and the first conductive layer covers a side surface the dielectric layer.

2. The device of claim 1, further comprising:

a second conductive layer which covers a part from an edge of a front surface of the dielectric layer; and a third conductive layer which covers a back surface of the dielectric layer.

3. The device of claim 2, wherein the first conductive layer, the second conductive layer, and the third conductive layer form a single layer.

4. The device of claim 2, wherein the first conductive layer, the second conductive layer, and the third conductive layer include one of a metal layer and a conductive coating material.

5. The device of claim 2, wherein the first conductive layer, the second conductive layer, and the third conductive layer are different layers.

6. The device of claim 2, further comprising:

a feeding unit which is provided inside an opening part that reaches the back surface of the antenna substrate from a back surface of the third conductive layer, and is electrically connected to the antenna substrate.

7. The device of claim 1, further comprising:

a second conductive layer which covers a part from an edge of a front surface of the dielectric layer; and a third conductive layer which covers a part from an edge of a back surface of the dielectric layer.

8. The device of claim 1, wherein the antenna substrate includes a first substrate and a second substrate arranged in a surface direction, and the first conductive layer covers an outer circumference side surface of the first substrate and the second substrate.

9. An antenna device comprising:

an antenna substrate which comprises on a front surface thereof a radiation element for transmitting/receiving radio waves;

a dielectric layer which covers the front surface and a back surface of the antenna substrate; and a first conductive layer which covers a side surface of the antenna substrate, wherein the first conductive layer is contact with the side surface of the antenna substrate, and the first conductive layer protrudes at least further towards one of the front surface side and the back surface than the antenna substrate.

* * * * *